United States Patent [19]

Garcia

[11] 3,934,620

[45] Jan. 27, 1976

[54] SYNCHRONIZING APPARATUS FOR THE DRAWING ROLLER AND THE WARP BEAM IN A LOOM

[76] Inventor: Francisco Marlasca Garcia, 44 Plaza Castilla Sabadell, Barcelona, Spain

[22] Filed: Nov. 15, 1973

[21] Appl. No.: 416,058

[30] Foreign Application Priority Data

Nov. 24, 1972 Spain ..... 408963

[52] U.S. Cl. ..... 139/99; 139/110; 139/304

[51] Int. Cl.[2] ..... D03D 49/06; D03D 49/20

[58] Field of Search ..... 139/99, 24, 105, 309, 100, 139/97, 304

[56] References Cited

UNITED STATES PATENTS

| | | | |
|---|---|---|---|
| 1,023,994 | 4/1912 | Coburn | 139/99 |
| 2,820,485 | 1/1958 | Selles | 139/99 |
| 2,888,955 | 6/1959 | Kondo | 139/99 |
| 3,010,482 | 11/1961 | White et al. | 139/99 |
| 3,160,177 | 12/1964 | Williams et al. | 139/24 |
| 3,308,854 | 3/1967 | Pfarrwaller | 139/99 |
| 3,677,305 | 7/1972 | Cutting et al. | 139/99 |

*Primary Examiner*—James Kee Chi

*Attorney, Agent, or Firm*—Toren, McGeady and Stanger

[57] ABSTRACT

To provide synchronization between the drawing roller and the warp beam of a loom, direct transmission is provided between the two members by means of an intermediate shaft which is independent of the speed of the loom. Any variation in the density of the fabric is transmitted to the intermediate shaft and an automatic adjustment is afforded in the drawing roller and the warp beam.

4 Claims, 6 Drawing Figures

SYNCHRONIZING APPARATUS FOR THE DRAWING ROLLER AND THE WARP BEAM IN A LOOM

CROSS-REFERENCE TO RELATED APPLICATION

Attention is directed to Applicant's co-pending application, Ser. No. 418,937, filed Nov. 26, 1973.

SUMMARY OF THE INVENTION

The present invention is directed to a loom and, more particularly, it concerns apparatus for providing automatic and synchronized operation of the drawing roller and warp beam of a loom. Such apparatus contributes a new concept both in the drive and in the control and adjustments relating to the fabric drawing means and to the unwinding of the warp beam.

At the present time, all of the mechanisms used for the control and synchronization of the drawing roller and warp beam in a loom have independent adjustments and control devices for each of them, and, as a result, defects in precision occur and, further, the operator must handle both of the individually regulated members and other disadvantages arise from this arrangement.

The primary object of the present invention is to incorporate a direct transmission between the drawing roller and the warp beam to obtain synchronized action between the two of them. Such operation is achieved by using a single operating member which automatically affords the desired synchronization without resort to any additional adjustment or regulation.

The various features of novelty which characterize the invention are pointed out with particularity in the claims annexed to and forming a part of this disclosure. For a better understanding of the invention, its operating advantages and specific objects attained by its use, reference should be had to the accompanying drawings and desscriptive matter in which there is illustrated and described a preferred embodiment of the invention.

DETAILED DESCRIPTION OF THE INVENTION

Figure 6:
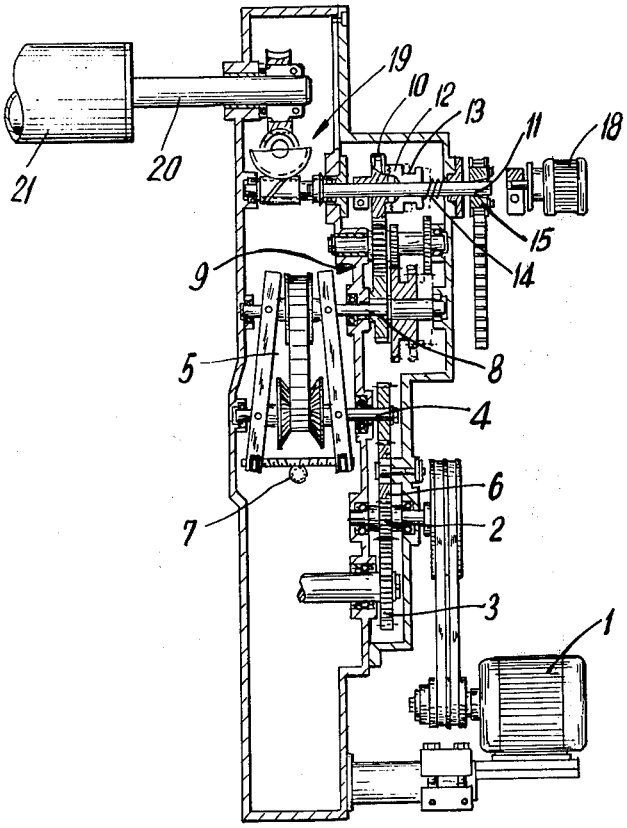
FIG. 6 is a sectional view taken along line C—C of FIG. 3.

In the drawing, apparatus is illustrated for the automatic and synchronized driving action between a drawing roller and a warp beam in a loom. A driving member 1 affords the principal driving action for the loom and through a pinion 2, it acts simultaneously on a loom movement synchronizing shaft 3 and a primary shaft 4 of a first conventional variator 5 (See FIG. 6). An intermediate pinion 6 transmits the action of the pinion 2 to the primary shaft 4. The first variator 5 includes a manual control device 7 for the density of the fabric and a driven shaft 8 on which is mounted a change mechanism 9 with a range of picks, which increases the possibilities of actuation of the loom.

Figure 1:
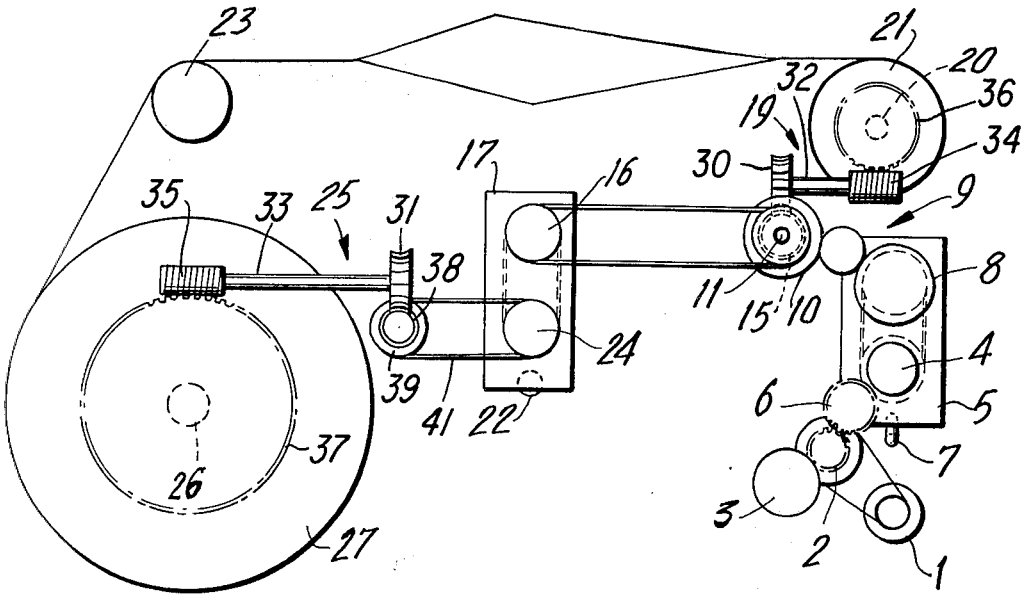
FIG. 1 is a schematic representation, in a side elevational view, of the apparatus embodying the present invention.
Figure 2:
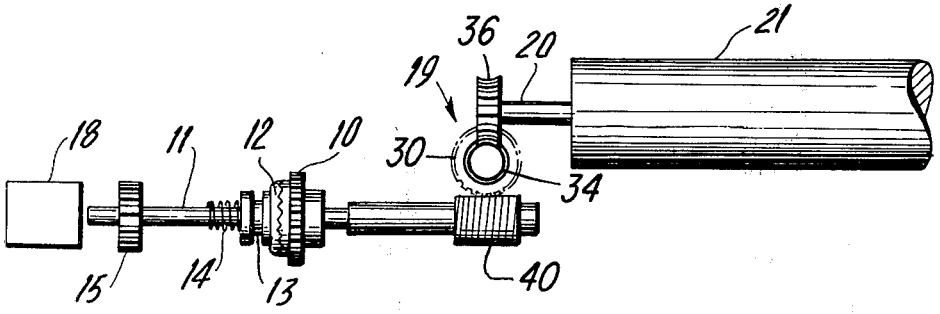
FIG. 2 is a schematic showing in a front elevational view of a portion of the apparatus illustrated in FIG. 1.
Figure 3:
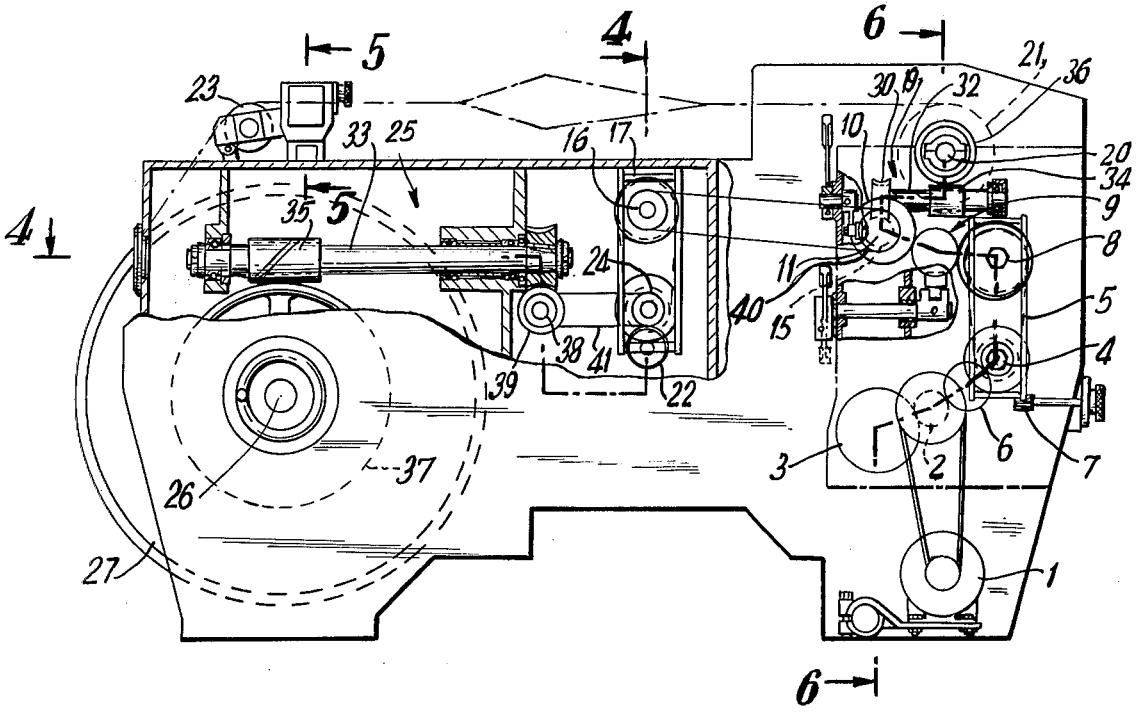
FIG. 3 is a detailed showing in section of the variators and change mechanism.
Figure 4:
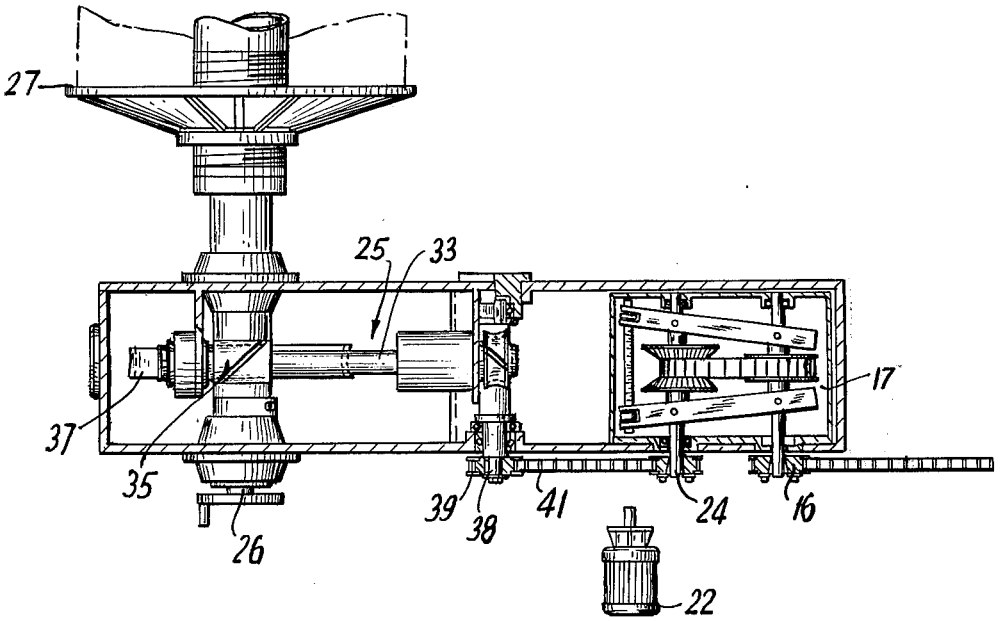
FIG. 4 is a sectional view taken along line A—A of FIG. 3.

Through an idle pinion 10, the change mechanism 9 acts on a shaft 11, note the arrangement of the shaft 11 shown in FIG. 2. A coupling action is provided on the shaft 11 by a clutch member 12 and a disc or plate 13 mounted on the shaft and elastically biased by a spring 14. In addition, a pinion 15 is mounted on the shaft 11 and acts through a transmission arrangement on the primary shaft 16 of a second conventional variator 17 (See FIG. 4.). At one end, the shaft terminates in an automatic device for member 18 and at its other end in a reduction assembly 19, which is in operative engagement with the shaft 20 of a fabric drawing roller 21. The reduction assembly 19 transmits rotary motion to the drawing roller 21 through a toothed pinion 30 in engagement with a worm screw 40 attached to the end of shaft 11, and to a shaft 32 of the toothed pinion 30 rotating a gear 36 affixed to the shaft 20 of the drawing roller 21 via a worm screw 34.

The second variator 17 includes an automatic control device 22, which may be either mechanical or electrical, which is in communication with a thread guide or compensating heck 23. Further, the second variator 17 has a driven shaft 24 which, by means of a suitable transmission through a second reducing assembly 25, drives the shaft 26 of a warp beam 27. The reducing assembly 25 transmits rotary motion to the warp beam 27 through a belt transmission 41 driven by shaft 24 which rotates a gear 39, a pinion 38 affixed to an end of the shaft of gear 39, a pinion 31 engaging the pinion 38 which rotates a shaft 33 having a worm screw 35 at one end engaging pinion 37 fixed on the shaft 26 of the warp beam 27.

Based on the above arrangement of elements, the loom operates in the following manner: The principal driving member 1 simultaneously controls the movement of the batten and weft inserting mechanism on one hand and, on the other hand, through an intermediate pinion the first variator 5. With the variator 5 actuated, its operation can be altered by the manual control device 7 for the purpose of selectively and continuously fixing the density of picks of the weft per centimeter of fabric. At the exit or outlet end of the variator 5, the change mechanism 9 permits the changing of the range of picks per centimeter as needed. On the intermediate shaft 11, which is in communication with the change mechanism 9 through the idle pinion 10, a clutch member 12 and the remainder of the coupling system on the shaft permits the automatic device 18 to disconnect the synchronized mechanism corresponding to the heck 23 of the fabric and warp unwinder 27 from the rest of the loom so that variations in density can be made for effecting patterns or reliefs in the fabric or for weaving and weaving backward, manual pick adjustment, and the pass of new warps. Accordingly, it is clear from this operation that the intermediate shaft 11 simultaneously drives the reduction assembly 19 of the drawing roller 21 and through the second variator 17, the reduction assembly 25 of the warp beam 27, both in forward motion (weaving) and in reverse motion (backward weaving).

The function of the second variator 17 is to correct the proper relation of synchronism of the kinematics involved, so that it is adapted to the diameter of the warp beam 27, with its regulation being provided through a mechanism which senses the tension of the warp and compares it, for example, with a system of weights or a spring system, so that it transforms any imbalance into a mechanical or electrical impulse which alters the position of the control device 22 of the variator, controlling its output speed to adapt it to the unwinding of thread which causes a constant fabric tension. Finally, the reducing assembly 25, driven from the exit or outlet end of the second variator 17, takes charge of driving the warp beam 27.

The change mechanism 9 is of conventional type and has two parallel shafts with respective pinions thereon which can be coupled or uncoupled with pinion 10. This change mechanism 9 can best be seen in FIG. 6 where it is shown connected between the pinion 10 and variator 5.

Figure 5:
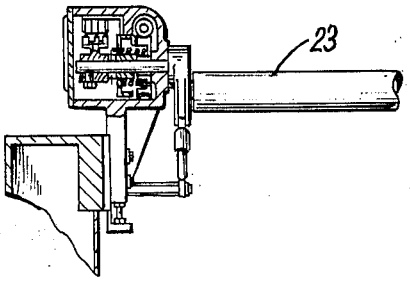
FIG. 5 is a sectional view taken along line B—B of FIG. 3 and shows in detail the heck and control for the heck.

FIG. 5 shows part of the controls for the heck 23, and which forms no part of the present invention. This control is the subject matter of co-pending application, Ser. No. 418,937, filed Nov. 26, 1973.

While a specific embodiment of the invention has been shown and described in detail to illustrate the application of the inventive principles, it will be understood that the invention may be embodied otherwise without departing from such principles.

What is claimed is:

1. Apparatus for use in a loom including a drawing roller and a warp beam for affording automatic and synchronized drive between said drawing roller and said warp beam, comprising means for affording direct transmission between said drawing roller and said warp beam, said means including an intermediate shaft, a first reduction assembly in engagement with said intermediate shaft for driving said drawing roller, a first variator having a primary shaft, a pinion on said intermediate shaft for driving said primary shaft of said first variator, a device in operative engagement with said intermediate shaft for controlling the density of the fabric loomed, and a second reduction assembly in operative engagement with said variator and said warp beam so that, independent of the speed of the loom, any variation in the density of the fabric is automatically corrected in said warp beam.

2. Apparatus, as set forth in claim 1, wherein uncoupling means including a coupling member mounted on said intermediate shaft and an automatic device associated with said intermediate shaft is arranged for uncoupling the remainder of the mechanism of the loom for facilitating weft density increases, manual pick adjustments, passes of new warps, and forward and backward weaving operations.

3. Apparatus, as set forth in claim 2, wherein said device in operative engagement with said intermediate shaft comprises a second variator, a drive motor for the loom in driving engagement with said second variator, said second variator including a fabric density regulating device, a second pinion mounted on said intermediate shaft, said second variator including a change mechanism in operative engagement with said second pinion on said intermediate shaft for driving said pinion, a compensating heck, a control device for said second variator, said heck actuating said control device for said second variator so that said warp beam moves synchronously with said drawing roller.

4. Apparatus for use in a loom including a drawing roller and a warp beam for providing automatic and synchronized drive between said drawing roller and said warp beam, comprising means for driving the loom, said means including a pinion, a loom movement synchronizing shaft, a first variator, a primary shaft for said first variator, an intermediate pinion in operative engagement with said primary shaft in said first variator, said pinion in said means for driving the loom acting simultaneously on said loom movement synchronizing shaft and on said intermediate pinion in operative engagement with said primary shaft for said first variator, a manual control device associated with said first variator for controlling the fabric density, a driven shaft in said first variator driven by said primary shaft therein, a change mechanism mounted on said driven shaft, an intermediate shaft, an idle pinion mounted on said intermediate shaft, and said idle pinion disposed in engagement with said change mechanism coupling means mounted on said intermediate shaft and including a ratchet, a plate and a biasing member resiliently urging said plate, a second pinion mounted on said intermediate shaft, a second variator having a primary shaft in operative engagement with said secondary pinion on said intermediate shaft, an automatic device associated with one end of said intermediate shaft and a first reduction assembly in operative engagement with the opposite end of said intermediate shaft, a shaft for said fabric drawing roller, and said shaft disposed in engagement with said first reduction assembly, said second variator including a control device and a driven shaft driven by its said primary shaft, a second reduction assembly in operative engagement with said driven shaft of said second variator, a warp beam shaft driven by said second reduction assembly and a compensating heck in operative communication with said control device in said second variator.

* * * * *